United States Patent [19]

Herchenroeder

[11] Patent Number: 4,460,542

[45] Date of Patent: Jul. 17, 1984

[54] IRON-BEARING NICKEL-CHROMIUM-ALUMINUM-YTTRIUM ALLOY

[75] Inventor: Robert B. Herchenroeder, Kokomo, Ind.

[73] Assignee: Cabot Corporation, Kokomo, Ind.

[21] Appl. No.: 381,477

[22] Filed: May 24, 1982

[51] Int. Cl.[3] ..... C22C 19/05

[52] U.S. Cl. ..... 420/443; 148/410; 148/428

[58] Field of Search ..... 420/445, 443, 442, 455; 148/410, 428

[56] References Cited

U.S. PATENT DOCUMENTS

| | | | |
|---|---|---|---|
| 3,017,265 | 1/1982 | McGurty | 75/126 |
| 3,027,252 | 3/1962 | McGurty | 75/126 |
| 3,754,898 | 8/1973 | McGurty | 75/122 |
| 3,754,902 | 8/1973 | Boone et al. | 75/171 |
| 3,832,167 | 8/1974 | Shaw et al. | 75/170 |
| 4,086,085 | 4/1978 | McGurty | 75/124 |
| 4,272,289 | 6/1981 | Herchenroeder et al. | 75/122 |
| 4,312,682 | 1/1982 | Herchenroeder | 75/171 |

FOREIGN PATENT DOCUMENTS 1575038 9/1980 United Kingdom .

*Primary Examiner*—R. Dean

*Attorney, Agent, or Firm*—Jack Schuman; Robert F. Dropkin

[57] ABSTRACT

A high temperature oxidation resistant alloy. The alloy consists essentially of, by weight, from 14 to 18% chromium, from 4 to 6% aluminum, from 1.5 to 8% iron, a small but effective yttrium content not exceeding 0.04%, up to 12% cobalt, up to 1% manganese, up to 1% molybdenum, up to 1% silicon, up to 0.25% carbon, up to 0.03% boron, up to 1% tungsten, up to 1% tantalum, up to 0.5% titanium, up to 0.5% hafnium, up to 0.5% rhenium, up to 0.04% of elements from the group consisting of elements 57 through 71 of the periodic table of the elements, balance essentially nickel. The nickel plus the cobalt content is at least 66%. The iron content is in accordance with the relationship, Fe $\geqq 3+4(\%Al-5)$, when the aluminum content is at least 5%.

13 Claims, 1 Drawing Figure

IRON-BEARING NICKEL-CHROMIUM-ALUMINUM-YTTRIUM ALLOY

Figure 1:
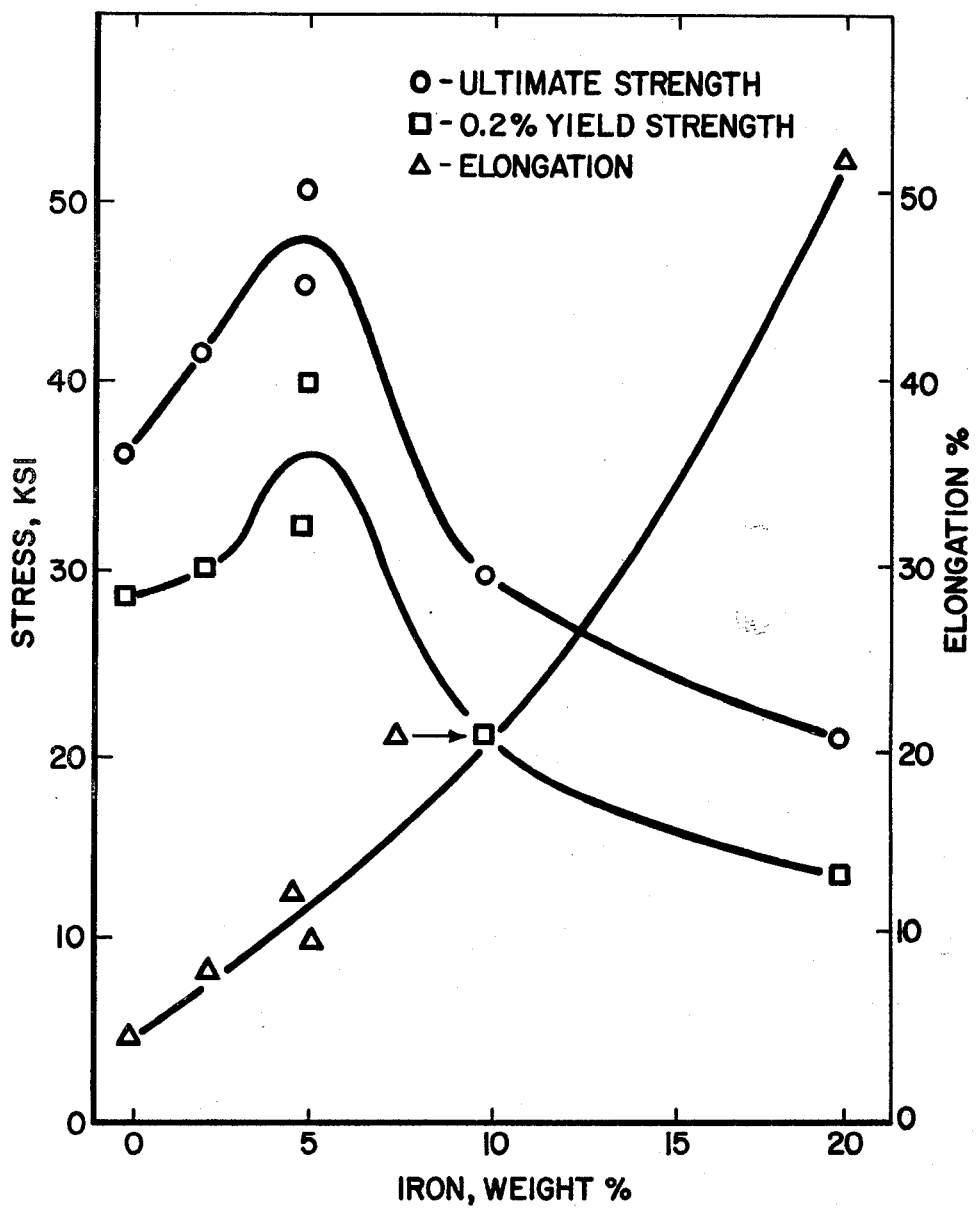

The present invention relates to a nickel-chromium-aluminum-yttrium alloy, and in particular, to an iron-bearing, nickel-chromium-aluminum-yttrium alloy.

Nickel-chromium-aluminum-alloys are known in the art. They contain chromium, aluminum and yttrium in a nickel base. They are noted for their excellent oxidation resistance. Their oxidation resistance is attributable to the formation of a protective oxide scale which is composed largely of alumina ($Al_2O_3$), modified by the presence of yttrium.

U.S. Pat. No. 4,312,682 teaches a nickel-chromium-aluminum-yttrium alloy especially suited for use in the manufacture of kiln hardware. The alloy contains, by weight, from 8 to 25% chromium, from 2.5 to 8% aluminum and a small but effective yttrium content not exceeding 0.04%, the balance being nickel, impurities and optional modifying elements.

Other references disclose somewhat similar alloys. These references include U.S. Pat. Nos. 3,754,902 and 3,832,167.

Despite the interest shown in nickel-chromium-aluminum-yttrium alloys, as noted by the references cited herein, these alloys have had limited commercial success. This is, in part, attributable to problems associated with their workability. In fact, a good portion of their usage has been cast forms and coating overlays.

Through the present invention, there is provided a nickel-chromium-aluminum-yttrium alloy of improved workability, and yet one still characterized by excellent oxidation resistance at very high temperatures (temperatures greater than 2000° F.). This desirable result is achieved by carefully controlling the aluminum content of the alloy and by adding iron in an amount dependent upon the aluminum content.

The alloy of the present invention is a nickel-base alloy having a controlled iron content of from 1.5 to 8%. It is clearly distinguishable from the alloys of the references cited hereinabove. Iron is critical to the alloy and not just an optional addition for which no benefit is attributable as is the case for the alloys of U.S. Pat. Nos. 4,312,682 and 3,832,167.

The alloy of the present invention is also distinguishable from the large number of somewhat similar but nickel-free and/or iron base alloys known to those skilled in the art. Examples of these alloys are found in U.S. Pat. Nos. 3,017,265; 3,027,252; 3,754,898; and 4,086,085; and in British Patent Specification No. 1,575,038.

It is accordingly an object of the present invention to provide a high temperature oxidation resistant alloy of improved workability.

It is a further object of the present invention to provide an iron-bearing, nickel-chromium-aluminum-yttrium alloy.

The foregoing and other objects of the invention will become apparent from the following detailed description taken in connection with the accompanying drawing which forms a part of this specification, and in which:

The FIGURE is a plot of the 1700° F. tensile properties for nickel-chromium-aluminum-yttrium alloys of varying iron content.

The present invention provides an iron-bearing, nickel-chromium-aluminum-yttrium alloy of improved workability, and yet one still characterized by excellent oxidation resistance at very high temperatures. The alloy consists essentially of, by weight, from 14 to 18% chromium, from 4 to 6% aluminum, from 1.5 to 8% iron, a small but effective yttrium content not exceeding 0.04%, up to 12% cobalt, up to 1% manganese, up to 1% molybdenum, up to 1% silicon, up to 0.25% carbon, up to 0.03% boron, up to 1% tungsten, up to 1% tantalum, up to 0.5% titanium, up to 0.5% hafnium, up to 0.5% rhenium, up to 0.04% of elements from the group consisting of elements 57 through 71 of the periodic table of the elements, balance essentially nickel. The nickel plus the cobalt content is at least 66%, and generally at least 71%. The preferred chromium content is from 15 to 17%. Yttrium is usually at least 0.005%. Cobalt should be below 2% as it tends to stabilize gamma prime. The preferred molybdenum plus tungsten content is less than 1% for similar reasons. Preferred maximum carbon and boron contents are respectively 0.1 and 0.015%.

Iron is present in an amount of from 1.5 to 8%, and preferably in an amount of from 2 to 6%. Controlled additions of iron have been found to improve the workability of the alloy without materially degrading its oxidation resistance. Iron has been found to reduce the effectiveness of the gamma prime precipitate as a hardening agent. At least 1.5%, and preferably at least 2%, is added for workability. No more than 8% is added so as to preserve the alloys oxidation resistance and high temperature strength. A modest but yet significant increase in yield strength is attributable to the presence of iron in the preferred range of from 2 to 6% (see the FIGURE and Example II). The iron content is preferably in accordance with the relationship, $Fe \geqq 3+4(\%Al-5)$, when the aluminum content is at least 5%.

Aluminum is present in an amount of from 4 to 6%, and preferably in an amount of from 4.1 to 5.1%. At least 4%, and preferably at least 4.1%, is added for oxidation resistance. Respective maximum and preferred maximum levels of 6 and 5.1% are called for as increasing aluminum contents are accompanied by increasing amounts of gamma prime. An iron content of at least 3% is preferably called for when the aluminum content is 5% or more. Iron, as stated hereinabove, has been found to reduce the effectiveness of gamma prime as a hardening agent.

The presence of iron, and in turn the improved workability of the alloy, makes the alloy particularly suitable for use in the manufacture of wrought articles. Its outstanding oxidation resistance renders it particularly suitable for use as hardware in ceramic kilns and heat treating furnaces.

The merit of the present invention will be appreciated by those skilled in the art. The present invention tends to minimize gamma prime formation by limiting the amount of aluminum, and additionally tends to reduce its effectiveness through the addition of iron. This is contrary to the typical objectives for superalloys containing aluminum. This is contrary to the typical objectives for superalloys which form gamma prime.

The following examples are illustrative of several aspects of the invention.

EXAMPLE I

Five thousand pound ingots were prepared from several heats (Heats A–H). The material was vacuum melted, cast into electrodes and electroslag remelted into ingots. The chemistry of the heats, aside from trace elements, is set forth hereinbelow in Table I.

TABLE I

| HEAT | COMPOSITION (wt. %) Cr | Al | Y | Fe | Ni |
|---|---|---|---|---|---|
| A. | 15.74 | 5.34 | 0.019 | <0.5 | 77.06 |
| B. | 16.07 | 5.36 | 0.027 | <0.5 | Bal |
| C. | 15.72 | 5.48 | <0.02 | <0.5 | 77.86 |
| D. | 16.25 | 5.14 | <0.01 | 0.51 | 78.14 |
| E. | 15.98 | 5.04 | <0.01 | 0.49 | 76.70 |
| F. | 16.13 | 5.48 | 0.012 | 0.11 | 77.85 |
| G. | 16.25 | 4.40 | 0.035 | 0.14 | 78.49 |
| H. | 16.07 | 4.36 | 0.022 | <0.5 | 77.83 |

The ingots were forged at temperatures of from 2050° to 2200° F. after heating cycles of up to 20 hours in duration. Gas torches, at the forging dies, were used to keep the ingots from Heats F, G and H hot during forging.

Recovery through breakdown forging was poor. The salvaged material required extensive conditioning, which was in this instance, grinding.

Wire from the salvaged material could only be drawn about 20% before repeated breakage occurred. When wire which had been cold drawn nominally 20% was annealed in coil form, nine of ten hoops fractured.

EXAMPLE II

Fifty pound ingots were prepared from several heats (Heats I–P). Aluminum aim points were 4 and 5%. Iron aim points ranged from a residual level to a range of from 2.5 to 20%. The material was vacuum melted, cast into electrodes and electroslag remelted into ingots. The chemistry of the heats, aside from trace elements, is set forth hereinbelow in Table II.

TABLE II

| HEAT | COMPOSITION (wt. %) Cr | Al | Y | Fe | Ni |
|---|---|---|---|---|---|
| I. | 15.11 | 4.64 | 0.01 | <0.25 | Bal |
| J. | 16.20 | 4.31 | 0.007 | 6.0 | 71.66 |
| K. | 16.54 | 3.93 | 0.013 | 0.61 | 78.0 |
| L. | 16.72 | 5.07 | 0.011 | 5.1 | 72.3 |
| M. | 15.79 | 4.66 | 0.012 | 4.79 | 73.12 |
| N. | 16.09 | 4.78 | 0.009 | 9.81 | 68.49 |
| O. | 16.18 | 4.84 | 0.015 | 19.58 | 58.60 |
| P. | 16.64 | 4.89 | 0.017 | 2.26 | 75.00 |

The ingots were forged to plate at 2050° F., hot rolled to an intermediate gauge of 0.075 inch at 2050° F., cold rolled to a finished gauge of 0.045 inch, annealed for 5 minutes at 2050° F. and fan cooled.

Sheets from all the heats, with the exception of Heat J, were tensile tested in the annealed condition at various temperature of from 1500° F. to 1900° F. The results of the tests are set forth hereinbelow in Table III. Standard ASTM E-21 procedures for elevated temperature tests were followed.

TABLE III

| HEAT | Test Temp. (°F.) | Yield Strength (ksi) | Ultimate Tensile Strength (ksi) | Elongation (%) |
|---|---|---|---|---|
| I | 1600 | 48.2 | 58.4 | 2.1 |
| (4.6 Al, | 1700 | 28.4 | 36.0 | 4.4 |
| 0 Fe) | | | | |
| K | 1500 | 57.9 | 75.2 | 10 |
| (3.9 Al, | 1600 | 41.0 | 50.4 | 10 |
| 0.6 Fe) | 1700 | 12.5 | 22.1 | 46 |

TABLE III-continued

| HEAT | Test Temp. (°F.) | Yield Strength (ksi) | Ultimate Tensile Strength (ksi) | Elongation (%) |
|---|---|---|---|---|
| | 1800 | 7.9 | 16.2 | 54 |
| | 1900 | 5.3 | 11.5 | 60 |
| L | 1500 | 71.4 | 71.4 | 2 |
| (5.1 Al, | 1600 | 59.7 | 74.2 | 4 |
| 5.1 Fe) | 1700 | 39.4 | 50.6 | 9 |
| | 1800 | 11.2 | 20.7 | 29 |
| | 1900 | 6.2 | 12.7 | 50 |
| M | 1500 | 66.3 | 86.1 | 5 |
| (4.7 Al, | 1600 | 56.7 | 75.8 | 6 |
| 4.8 Fe) | 1700 | 32.3 | 45.8 | 12 |
| | 1800 | 9.4 | 17.6 | 47 |
| | 1900 | 5.9 | 12.3 | 52 |
| N | 1500 | 62.7 | 80.3 | 4 |
| (4.8 Al, | 1600 | 42.5 | 58.9 | 8 |
| 9.8 Fe) | 1700 | 21.0 | 29.4 | 21 |
| | 1800 | 8.6 | 16.6 | 51 |
| | 1900 | 5.7 | 11.3 | 52 |
| O | 1500 | 63.8 | 80.9 | 5 |
| (4.8 Al, | 1600 | 34.1 | 49.7 | 16 |
| 19.6 Fe) | 1700 | 13.0 | 20.6 | 52 |
| | 1800 | 7.6 | 14.7 | 57 |
| | 1900 | 5.2 | 11.3 | 54 |
| P | 1500 | 65.4 | 81.8 | 2 |
| (4.9 Al, | 1600 | 53.7 | 73.4 | 3 |
| 2.3 Fe) | 1700 | 29.2 | 41.7 | 8 |
| | 1800 | 17.0 | 25.5 | 18 |
| | 1900 | 5.8 | 11.5 | 53 |

The 1700° F. tensile properties for Heats I and L–P were plotted (see the FIGURE). Note how elongation increases with increasing amounts of iron. Also note the desirable combination of strength and elongation achieved with the preferred iron content (2 to 6%) of the subject invention.

EXAMPLE III

Two five thousand pound ingots were prepared from Heat Q. The material was vacuum melted, cast into electrodes and electroslag remelted into ingots. The chemistry of Heat Q, aside from trace elements, is set forth hereinbelow in Table IV.

TABLE IV

| HEAT | Composition (wt. %) Cr | Al | Y | Fe | Ni |
|---|---|---|---|---|---|
| Q | 16.16 | 4.29 | 0.007 | 2.62 | 76.25 |

The ingots were forged as were the ingots of Example I. Gas torches were not used at the dies to maintain heat during forging.

Both ingots forged well. Recovery after forging was far better than that for the ingots of Example I and averaged in excess of 80%. The ingots had 2.62% iron, whereas the highest iron content for any of the ingots of Table I was 0.51%. The alloy of the subject invention has from 1.5 to 8% iron. Recoveries after forging of less than 30% were typical for heats having less iron.

Material from Heat Q was both hot and cold worked with excellent results. Hot rolled sheets were annealed and quenched without any cracking. Wire having a diameter of 0.25 inch and a cross sectional area of 0.0491 sq. inch was cold reduced to a cross sectional area of 0.0204 sq. inch (58%) without intermediate annealing, and was subsequently annealed without any cracking.

EXAMPLE IV

Static oxidation tests were conducted at 2100° F. for 500 hours to compare the oxidation resistance of two alloys within the subject invention with one having less than 1.5% iron. The alloys within the subject invention were L (5.07 Al, 5.1 Fe) and P (4.89 Al, 2.26 Fe). The alloy outside the subject invention was K (3.93 Al, 0.61 Fe). The test is described in U.S. Pat. No. 4,272,289 which issued on June 9, 1981.

The results of the tests appear hereinbelow in Table V.

TABLE V

| | Static Oxidation Data 500 hours/2100° F. | | | |
|---|---|---|---|---|
| Alloy | Metal Loss (mils/surface) | Continuous Penetration (mils/surface) | Oxide Penetration (mils/surface) | Total Metal Affected (mils/surface) |
| L | 0.08 | 0.35 | 0.43 | 2.66 |
| P | 0.05 | 0.39 | 0.44 | 2.53 |
| K | 0.02 | 0.18 | 0.20 | 2.76 |

The results indicate that iron (within the range of the present invention) does not have a notable adverse affect on oxidation resistance. Although the conclusion is not affected thereby, there is doubt as to the actual magnitude of the numbers set forth in the Table.

EXAMPLE V

Additional static oxidation tests were conducted at 2100° F. to compare the oxidation resistance of two more alloys within the subject invention with one having less than 1.5% iron. The alloys within the subject invention were J (4.31 Al, 6.0 Fe) and Q (4.29 Al, 2.62 Fe). The alloy outside the subject invention was E (5.04 Al, 0.49 Fe). Alloys J and Q were tested for 500 hours. Alloy E was tested for 100 hours.

The results of the tests appear hereinbelow in Table VI.

TABLE VI

| | STATIC OXIDATION DATA | | | |
|---|---|---|---|---|
| Alloy | Metal Loss (mils/surface) | Continuous Penetration (mils/surface) | Oxide Penetration (mils/surface) | Total Metal Affected (mils/surface) |
| J | 0.01 | 0.10 | 0.12 | 0.12 |
| Q | 0.12 | 0.17 | 0.29 | 0.41 |
| E | 0.05 | 0.1 | 0.15 | 0.15 |

The results indicate that iron (within the range of the present invention) does not have an adverse affect on oxidation resistance. This is especially evident in view of the fact that Heats J and Q were tested for 500 hours compared to 100 hours for Heat E.

It will be apparent to those skilled in the art that the novel principles of the invention disclosed herein in connection with specific examples thereof will support various other modifications and applications of the same. It is accordingly desired that in construing the breadth of the appended claims they shall not be limited to the specific examples of the invention described herein.

I claim:

1. A high temperature oxidation resistant alloy of improved workability consisting essentially of, by weight, from 14 to 18% chromium, from 4 to 6% aluminum, from 2 to 6% iron, a small but effective yttrium content not exceeding 0.04% to promote oxidation resistance, up to 12% cobalt, up to 1% manganese, up to 1% molybdenum, up to 1% silicon, up to 0.25% carbon, up to 0.03% boron, up to 1% tungsten, up to 1% tantalum, up to 0.5% titanium, up to 0.5% hafnium, up to 0.5% rhenium, up to 0.04% of elements from the group consisting of elements 57 through 71 of the periodic table of the elements, balance essentially nickel; said nickel plus said cobalt being at least 66%.

2. An alloy according to claim 1, having from 15 to 17% chromium.

3. An alloy according to claim 1, having from 4.1 to 5.1% aluminum.

4. An alloy according to claim 1, having a nickel plus cobalt content of at least 71%.

5. An alloy according to claim 1, having from 15 to 17% chromium, from 4.1 to 5.1% aluminum and a nickel plus cobalt content of at least 71%.

6. An alloy according to claim 1, having less than 2% cobalt.

7. An alloy according to claim 1, having less than 0.1% carbon and less than 0.015% boron.

8. An alloy according to claim 1, having at least 5% aluminum and at least 3% iron.

9. An alloy according to claim 8, wherein said iron content is in accordance with the relationship $Fe \geqq 3+4(\%Al-5)$.

10. An alloy according to claim 1, having a molybdenum plus tungsten content of less than 1%.

11. A wrought article made from the alloy of claim 1.

12. An article for use as hardware in ceramic kilns, made from the alloy of claim 1.

13. An article for use as hardware in heat treating furnaces, made from the alloy of claim 1.

* * * * *